US010287144B2

(12) United States Patent
Harauchi et al.

(10) Patent No.: US 10,287,144 B2
(45) Date of Patent: May 14, 2019

(54) JIB CONNECTION STRUCTURE

(71) Applicant: TADANO LTD., Kagawa (JP)

(72) Inventors: Yuji Harauchi, Kagawa (JP); Yuki Hata, Kagawa (JP)

(73) Assignee: TADANO LTD., Kagawa (JP)

( * ) Notice: Subject to any disclaimer, the term of this patent is extended or adjusted under 35 U.S.C. 154(b) by 172 days.

(21) Appl. No.: 15/521,076

(22) PCT Filed: Oct. 27, 2015

(86) PCT No.: PCT/JP2015/005380
§ 371 (c)(1),
(2) Date: Apr. 21, 2017

(87) PCT Pub. No.: WO2016/151647
PCT Pub. Date: Sep. 29, 2016

(65) Prior Publication Data

US 2018/0037446 A1 Feb. 8, 2018

(30) Foreign Application Priority Data

Mar. 20, 2015 (JP) ..... 2015-057900

(51) Int. Cl.
*B66C 23/70* (2006.01)
*B66C 23/66* (2006.01)

(52) U.S. Cl.
CPC ..... *B66C 23/702* (2013.01); *B66C 23/66* (2013.01)

(58) Field of Classification Search
CPC ..... B66C 23/70; B66C 23/702; B66C 23/66
See application file for complete search history.

(56) References Cited

U.S. PATENT DOCUMENTS 4,155,464 A * 5/1979 Hogg ..... B66C 23/702 212/300
4,658,972 A * 4/1987 Koizumi ..... B66C 23/702 212/230

(Continued)

FOREIGN PATENT DOCUMENTS

JP 02-127693 10/1990
JP 11-011878 1/1999

(Continued)

OTHER PUBLICATIONS

Jan. 19, 2016, International Search Report issued for related WO application No. PCT/JP2015/005380.

*Primary Examiner* — Emmanuel M Marcelo
(74) *Attorney, Agent, or Firm* — Paratus Law Group, PLLC

(57) ABSTRACT

Provided is a jib connection structure for restraining a projectable/retractable jib from swinging sideways in a state where the jib is suspended from a boom tip end part, the jib connection structure including: jib connection shafts projecting horizontally toward both sides from a boom tip end part; and jib base end engagement parts respectively provided to bifurcated jib base end parts. Each jib base end engagement part is U-shaped into which the jib connection shaft can be fitted, and is provided with an insertion hole into which a pin for preventing the jib connection shaft from slipping out is inserted. The insertion hole in one jib base end engagement part is arranged more toward the outside than a U-shaped bottom part. When a jib is suspended from the boom tip end part, the left and right pins engage with the respective jib connection shafts, and the jib is suspended at two points.

4 Claims, 10 Drawing Sheets

(56) References Cited

U.S. PATENT DOCUMENTS

| | | | | | |
|---|---|---|---|---|---|
| 4,953,724 | A * | 9/1990 | Koizumi | B66C 23/702 | 212/300 |
| 5,111,945 | A * | 5/1992 | Hull | B66C 23/702 | 212/168 |
| 5,115,925 | A * | 5/1992 | Koizumi | B66C 23/702 | 212/300 |
| 5,140,929 | A * | 8/1992 | Gaspard | B66C 23/702 | 212/177 |
| 5,193,698 | A * | 3/1993 | Koizumi | B66C 23/702 | 212/168 |
| 2009/0139948 | A1* | 6/2009 | Holly | B66C 23/70 | 212/292 |
| 2012/0241403 | A1* | 9/2012 | Ethington | B66C 23/44 | 212/281 |
| 2014/0174018 | A1* | 6/2014 | Walker | B66C 23/70 | 52/637 |
| 2015/0203338 | A1* | 7/2015 | Albinger | B66C 23/821 | 52/651.07 |
| 2018/0346292 | A1* | 12/2018 | Kuhn et al. | B66C 23/702 | 212/292 |

FOREIGN PATENT DOCUMENTS

| | | | | |
|---|---|---|---|---|
| JP | 2006-264956 | | 10/2006 | |
| JP | 2011-131975 | | 7/2011 | |
| WO | WO-9737927 | A1 * | 10/1997 | B66C 23/702 |

* cited by examiner

JIB CONNECTION STRUCTURE

CROSS REFERENCE TO PRIOR APPLICATION

This application is a National Stage Patent Application of PCT International Patent Application No. PCT/JP2015/005380 (filed on Oct. 27, 2015) under 35 U.S.C. § 371, which claims priority to Japanese Patent Application No. 2015-057900 (filed on Mar. 20, 2015), which are all hereby incorporated by reference in their entirety.

TECHNICAL FIELD

The present invention relates to jib connection structures, and more specifically, to a connection structure between a boom leading end and jib base end.

BACKGROUND ART

Patent Literature (hereinafter, referred to as "PTL") 1 discloses a jib connection structure composed of a jib connection shaft projecting in both lateral directions of a boom leading end and jib base end engagement portions provided at a bifurcated jib base end. The jib base end engagement portions are U-shaped and can be engaged with the jib connection shaft. The jib base end engagement portions can be connected to the jib connection shaft by engaging the jib base end engagement portions with the jib connection shaft and inserting pins into through holes in leading ends of the jib base end engagement portions.

For a jib projection operation, a jib is firstly placed in a lower holding position of a boom and the jib base end engagement portions are connected to the jib connection shaft. At this time, the jib is placed at a slight angle with respect to the boom ("offset placement"). One of the jib base end engagement portions is formed to be longer than the other to allow the pins to be inserted into the through holes in the jib base end engagement portions while the jib base end engagement portions remain in the offset placement. Subsequently, the boom is elevated up, so that the jib is suspended from the boom leading end. Lastly, the jib is projected, by exerting tension on a tension rod. A jib stowage operation is done in a procedure reverse to the jib projection operation.

The jib base end engagement portions on the right and left have longitudinal dimensions different from each other, and the pins on the right and left to be inserted into the jib base end engagement portions are also located at different positions. Accordingly, in a state where the jib is suspended from the boom leading end, only one of the pins is locked to the jib connection shaft, and the jib is suspended at this one point. Consequently, there is a problem that the jib swings sideways and is not stabilized, so that it is difficult to carry out the jib projection/stowage operation.

CITATION LIST

Patent Literature

PTL 1: Japanese Patent Application Laid-Open No. 2006-264956

SUMMARY OF THE INVENTION

Problems to be Solved by the Invention

It is therefore an object of the present invention to provide a jib connection structure capable of restraining a jib from swinging sideways in a state where the jib is suspended from a boom leading end.

Solutions to Problems

A jib connection structure of a first aspect of the invention is a connection structure between a leading end of a boom and a base end of a jib, the connection structure including a jib connection shaft horizontally projecting in both lateral directions of the leading end of the boom; and jib base end engagement portions provided at respective ends of the bifurcated base end of the jib, in which: the jib base end engagement portions are U-shaped into which the jib connection shaft is allowed to be fitted, and include insertion holes for insertion of pins, the pins being intended for preventing slipping off of the jib connection shaft; the insertion holes in one of the jib base end engagement portions are placed laterally outwardly from a U-shaped bottom portion; and the insertion holes are located at a position at which the pins are allowed to be inserted into the insertion holes in a state where the jib connection shaft is fitted into the jib base end engagement portions and a leading end of the jib is placed laterally from the boom, and at which the inserted right and left pins are locked to the jib connection shaft in a state where the jib is suspended from the leading end of the boom.

A jib connection structure of a second aspect of the present invention is a connection structure between a leading end of a boom and a base end of a jib, the connection structure including a jib connection shaft horizontally projecting in both lateral directions of the leading end of the boom; and jib base end engagement portions provided at respective ends of the bifurcated base end of the jib, in which: the jib base end engagement portions are U-shaped into which the jib connection shaft is allowed to be fitted, and include insertion holes for insertion of pins, the pins being intended for preventing slipping off of the jib connection shaft; the insertion holes in one of the jib base end engagement portions are placed laterally outwardly from a U-shaped bottom portion; a line that connects the right and left insertion holes is inclined with respect to a plane perpendicular to a central axis of the jib; and a center of gravity of the jib lies between two planes perpendicular to the line connecting the right and left insertion holes, the two planes including the respective insertion holes.

Effects of the Invention

According to the first and/or the second aspect(s) of the invention, in the state where the jib is suspended from the boom leading end, the right and left pins are locked to the jib connection shaft, and the jib is suspended at two points. Therefore, the jib is restrained from swinging sideways, and a jib projection/stowage operation is easily carried out.

DESCRIPTION OF EMBODIMENTS

In the following, an embodiment of the present invention will be described with reference to the drawings.

Figure 1:
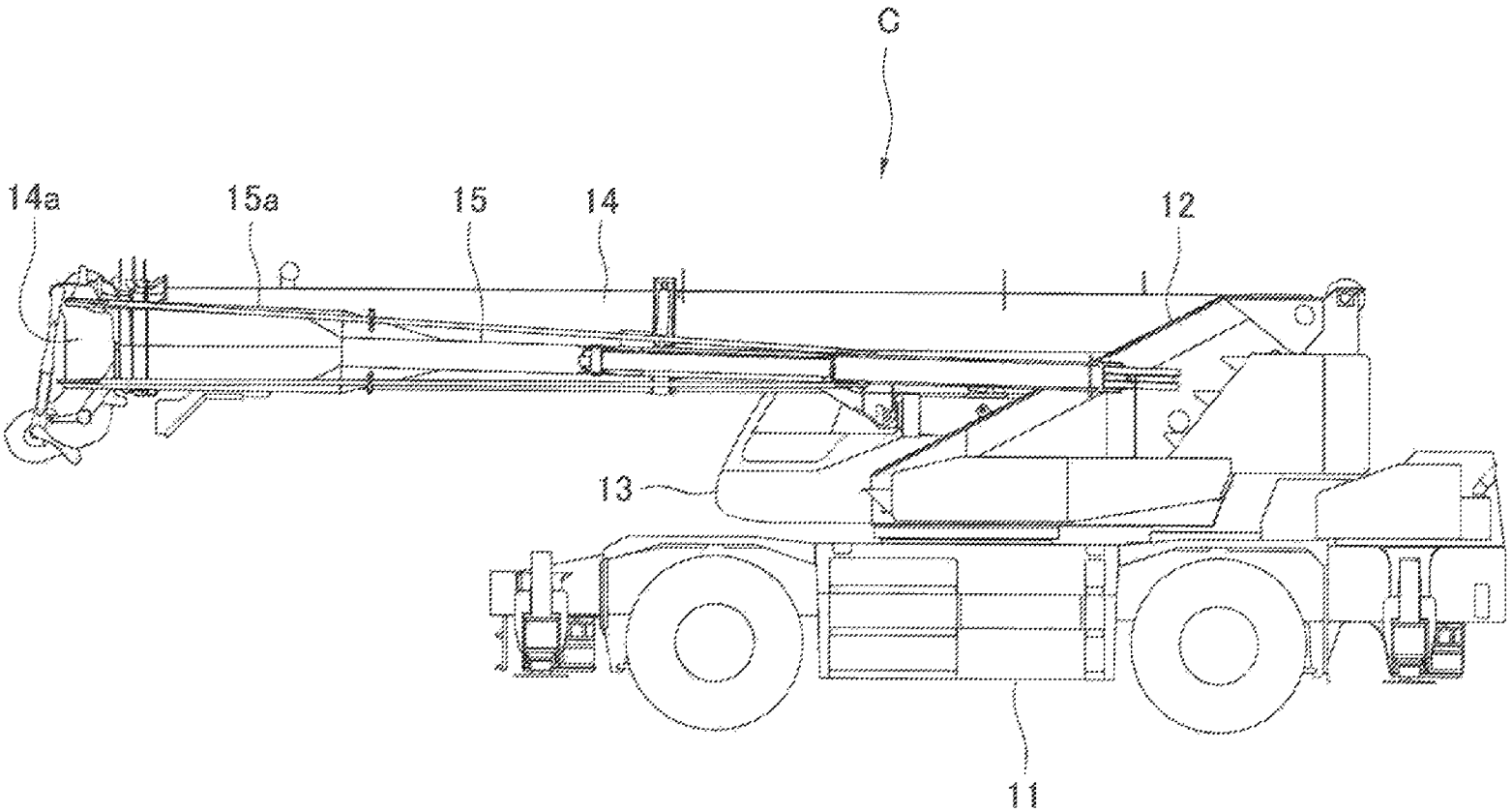
FIG. 1 is a side view illustrating a mobile crane C in which jib 15 is in a stowed condition.

A jib connection structure according to one embodiment of the invention is applied, for example, to mobile crane C as illustrated in FIG. 1. The jib connection structure according to the embodiment, however, is not limited to mobile crane C as illustrated in FIG. 1 and can be applied to different cranes.

(Mobile Crane)

To begin with, the basic structure of mobile crane C will be described.

Reference numeral 11 in FIG. 1 indicates a traveling chassis provided with wheels for traveling. Slewing base 12 is mounted on chassis 11 in such a manner as to be able to slew 360 degrees in the horizontal plane by a slewing motor. Slewing base 12 is provided with operator's cab 13.

Boom 14 is attached to slewing base 12 such that boom 14 can be freely elevated and lowered. A base end of boom 14 is pivotally supported by a pin on slewing base 12. A boom elevating cylinder is attached between boom 14 and slewing base 12. Boom 14 is elevated when the boom elevating cylinder is extended, and lowered when the boom elevating cylinder is retracted. Boom 14 is a telescopically designed multi-section boom and is extended or retracted by a telescopic cylinder.

A wire rope provided with a hook (not illustrated) is suspended from leading end 14*a* of boom 14, and is guided along boom 14 to slewing base 12 and wound around a winch. The winch is driven to rotate forward and reverse by a hoist motor, to wind up and pay out the wire rope, thereby allowing the hook to be moved up and down.

Combination of slewing of slewing base 12; elevating, lowering, extending, and retracting of boom 14; and moving up and down of the hook allows loading and unloading in a three-dimensional space.

Further, mobile crane C is provided with jib 15. Jib 15 as a whole is an elongated bar member, base end 15*a* of which is bifurcated. Jib 15 is employed for achieving a lifting height and/or operating radius still greater than a lifting height and/or operating radius of the boom length of fully extended boom 14. When jib 15 is not used, jib 15 is stowed along a side of boom 14 (see FIG. 1). When jib 15 is used, base end 15*a* of jib 15 is connected to leading end 14*a* of boom 14, and jib 15 is projected forward from boom 14 (see FIG. 10).

(Jib Connection Structure)

In the following, the jib connection structure of the embodiment will be described.

The jib connection structure of the embodiment is a structure for connecting leading end 14*a* of boom 14 (hereinafter referred to as "boom leading end 14*a*") to base end 15*a* of jib 15 (hereinafter referred to as "jib base end 15*a*") in mobile crane C as described above.

Figure 2:
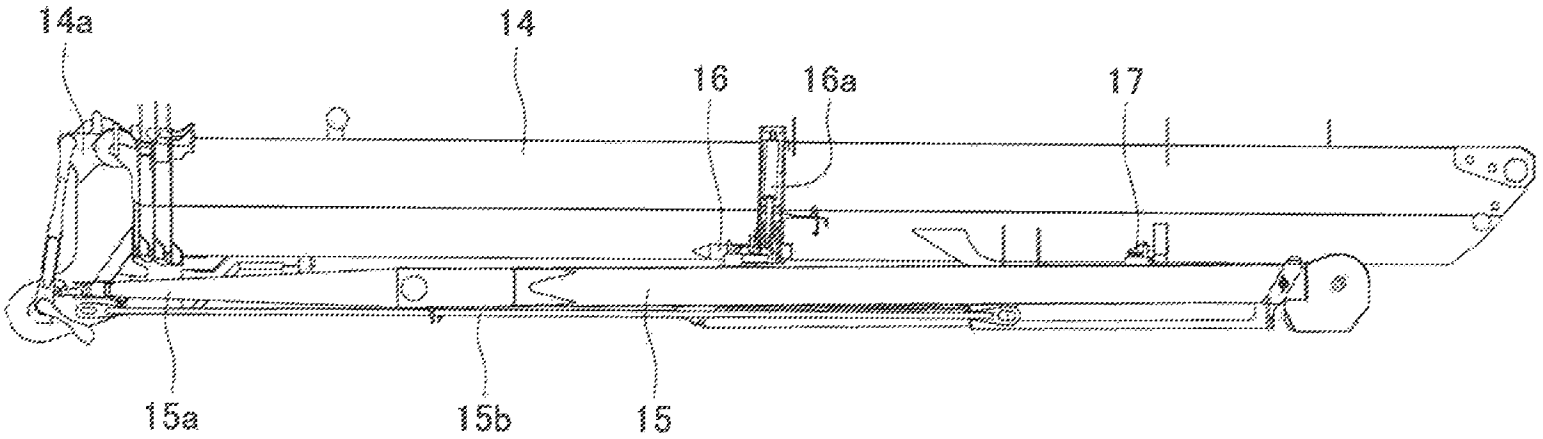
FIG. 2 is a side view of jib 15 and boom 14, in which jib 15 is placed in a lower holding position of boom 14.
Figure 3:
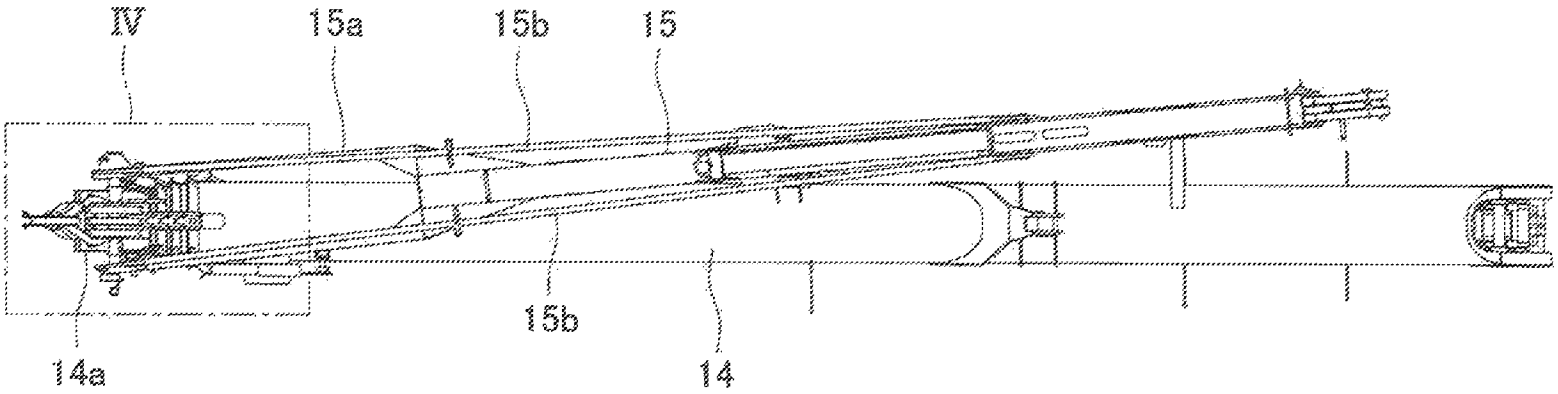
FIG. 3 is a bottom view of jib 15 and boom 14, in which jib 15 is placed in the lower holding position of boom 14.

FIGS. 2 and 3 are side and bottom views illustrating a state where jib 15 is placed in a lower holding position in which jib 15 is placed along the bottom of boom 14. As will be described below, in a jib projection/stowage operation, boom leading end 14*a* is connected to/disconnected from jib base end 15*a* in the state where jib 15 is placed in the lower holding position.

As illustrated in FIG. 3, in the state where jib 15 is placed in the lower holding position, jib 15 is in an offset placement in which jib base end 15*a* is located at boom leading end 14*a*, and a leading end of jib 15 is located laterally from boom 14. In this respect, the leading end of jib 15 is located on the opposite side of operator's cab 13 with respect to boom 14. Hereinafter, in the offset placement, the side on which the leading end of jib 15 is located is referred to as the left side, and the opposite side thereto (the side of operator's cab 13) is referred to as the right side. However, an embodiment in which the right and left sides are reversed is possible.

Figure 4:
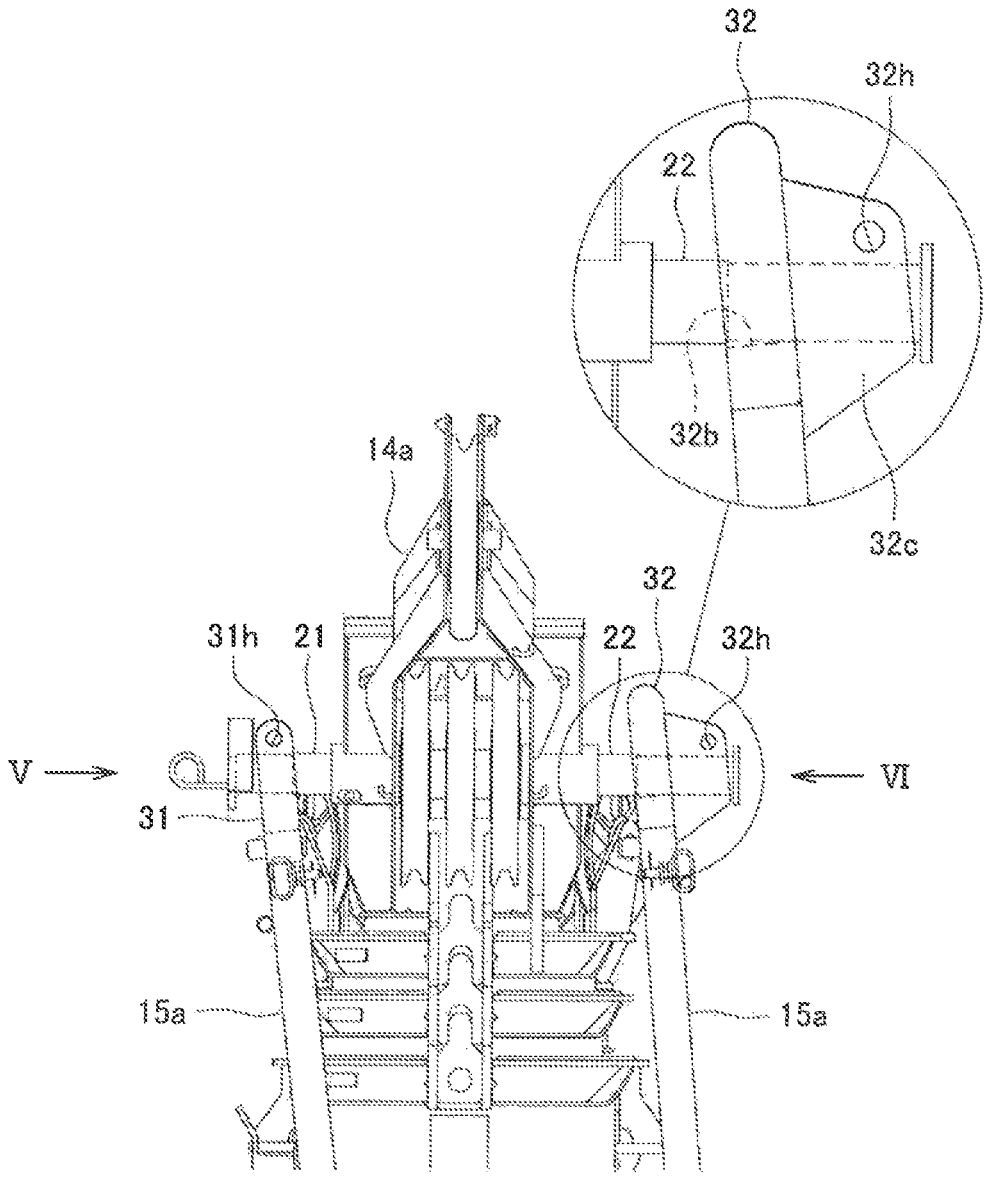
FIG. 4 is an enlarged view of region IV in FIG. 3.

As illustrated in FIG. 4, boom leading end 14*a* is provided with jib connection shafts 21, 22 horizontally projecting in both lateral directions of boom leading end 14*a*. Right and left jib connection shafts 21, 22 are coaxially placed. Further, respective ends of bifurcated jib base end 15*a* are provided with jib base end engagement portions 31, 32.

Figure 5:
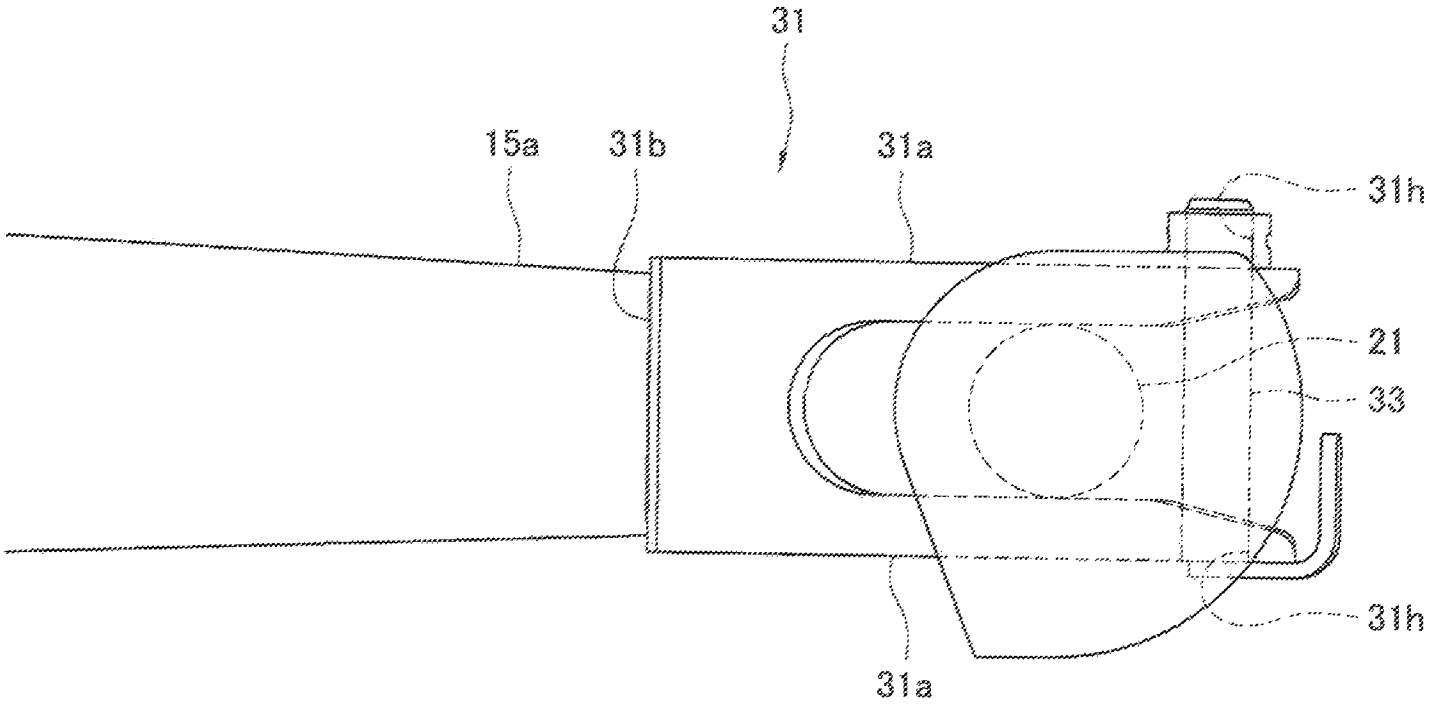
FIG. 5 is an enlarged view as seen in the direction of arrow V in FIG. 4.

As illustrated in FIG. 5, right jib base end engagement portion 31 is formed to have a U-shape composed of a pair of arms 31*a* and bottom portion 31*b* connecting base parts of the arms. The U-shape of jib base end engagement portion 31 has an inner diameter slightly greater than an outer diameter of right jib connection shaft 21. As a result, jib connection shaft 21 can be fitted between the pair of arms 31*a*. In the meantime, bottom portion 31*b* is a member in which the inner surface of bottom portion 31*b*, in a state where jib 15 is projected, makes contact with jib connection shaft 21 so as to transmit force acting on jib 15 to jib connection shaft 21.

Insertion holes 31*h* are formed in leading ends of the pair of arms 31*a*. Jib connection shaft 21 is prevented from slipping off by fitting jib connection shaft 21 into jib base end engagement portion 31 and inserting pin 33 into insertion holes 31*h*. Jib base end engagement portion 31 can thus be connected to jib connection shaft 21.

Figure 6:
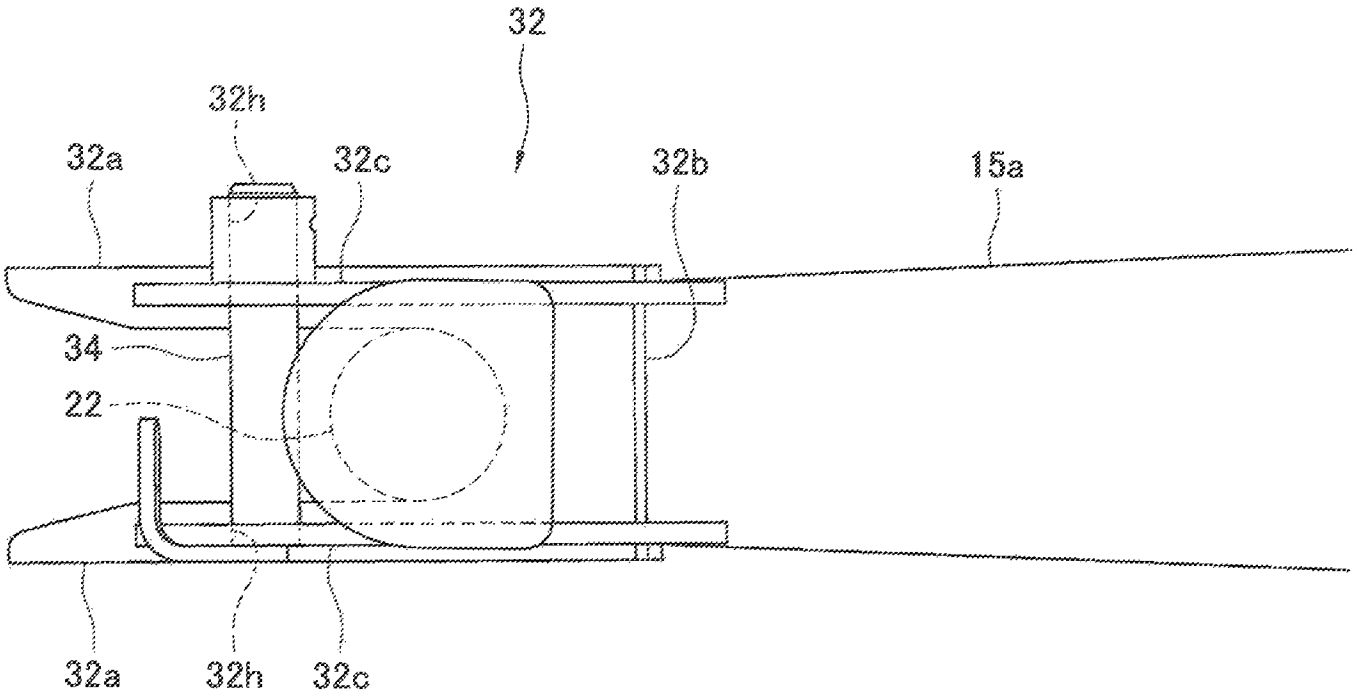
FIG. 6 is an enlarged view as seen in the direction of arrow VI in FIG. 4.

As illustrated in FIG. 6, left jib base end engagement portion 32 is formed to have a U-shape composed of a pair of arms 32*a* and bottom portion 32*b* connecting base parts of the arms. The U-shape of jib base end engagement portion 32 has an inner diameter slightly greater than an outer diameter of left jib connection shaft 22. Jib connection shaft 22 can thus be fitted between the pair of arms 32*a*. In the meantime, bottom portion 32*b* is a member in which the inner surface of bottom portion 32*b*, in the state where jib 15 is projected, makes contact with jib connection shaft 22 so as to transmit force acting on jib 15 to jib connection shaft 22.

Sides of arms 32*a* are each provided with extension plates 32*c*, with extension plates 32*c* projecting outwardly. These extension plates 32*c* are provided with insertion holes 32*h*. Jib connection shaft 22 is prevented from slipping off by fitting jib connection shaft 22 into jib base end engagement portion 32 and inserting pin 34 into insertion holes 32*h*. Jib base end engagement portion 32 can thus be connected to jib connection shaft 22.

As illustrated in FIG. 4, left jib base end engagement portion 32 is provided with extension plates 32*c*, and extension plates 32*c* are provided with insertion holes 32*h*. Insertion holes 32*h* are thus placed laterally outwardly from bottom portion 32*b* on which a load is applied in the state where jib 15 is projected.

The positional relationship between right and left insertion holes 31*h*, 32*h* (namely, the positional relationship between right and left pins 33, 34) will be described with reference to FIG. 7.

Figure 7:
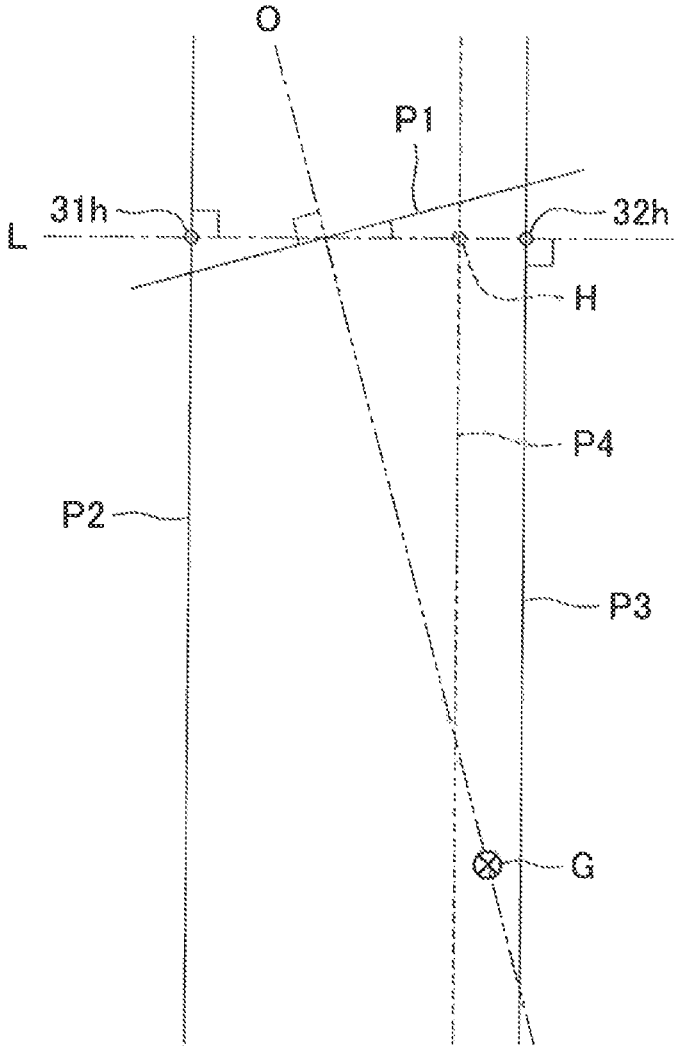
FIG. 7 illustrates the positional relationship between right and left insertion holes 31*h*, 32*h;*

In FIG. 7, long dashed double-dotted line O represents the central axis of jib 15, and point G represents a center of gravity of jib 15. Long dashed short dashed line L represents a line that connects right and left insertion holes 31*h*, 32*h*. Central axis O and line L are parallel to the plane of the paper.

P1 represents a plane perpendicular to central axis O of jib 15. Plane P1 is perpendicular to the plane of the paper, and thus illustrated by a line in FIG. 7. Line L connecting right and left insertion holes 31*h*, 32*h* is inclined with respect to plane P1. As a result, when right and left insertion holes 31*h*, 32*h* are placed parallel to jib connection shafts 21, 22, the leading end of jib 15 is placed laterally from boom 14. Accordingly, in a state where jib connection shafts 21, 22 are fitted into jib base end engagement portions 31, 32, and the leading end of jib 15 is placed laterally from boom 14 (see FIG. 3), pins 33, 34 can be inserted into insertion holes 31*h*, 32*h* without interfering with jib connection shafts 21, 22.

P2 represents a plane perpendicular to line L, including right insertion holes 31*h*. P3 represents a plane perpendicular to line L, including left insertion holes 32*h*. Planes P2, P3 are perpendicular to the plane of the paper, and thus illustrated by lines in FIG. 7. Center of gravity G of jib 15 lies between these two planes P2, P3. Accordingly, right and left pins 33, 34 are locked to jib connection shafts 21, 22 in a state where jib 15 is suspended from boom leading end 14*a* as will be described below. That is, jib 15 is suspended at two points. Meanwhile, in the state where jib 15 is suspended from boom leading end 14*a*, planes P2, P3 are provided as vertical planes.

Suppose that left insertion holes 32*h* are located at point H. P4 represents a plane perpendicular to line L, including point H. In this case, center of gravity G of jib 15 lies outside two planes P2, P4. Therefore, when jib 15 is suspended from boom leading end 14*a*, the moment acts about point H to rotate jib 15. As a result, only left pin 34 is locked to jib connection shat 22. That is, jib 15 is suspended at one point. The position of point H corresponds, for example, to the position of the leading end of arm 32*a* of jib base end engagement portion 32. This is the reason for the state where a jib in a conventional jib connection structure is suspended at one point.

In particular, in the case of large cranes, jib 15 is long, so that the offset placement causes center of gravity G to be deviated widely laterally and lie outside right and left pins 33, 34. Further, increasing the diameter of component members of jib 15 to increase its stiffness causes center of gravity G to move to the side of the leading end of jib 15. Placing a hydraulic cylinder for tilting and/or extending or retracting jib 15 on the leading end of jib 15 in an attempt at labor-saving also causes center of gravity G to move to the side of the leading end of jib 15. Also in a case where center of gravity G lies on the side of the leading end of jib 15 in this way, the offset placement causes center of gravity G to lie outside right and left pins 33, 34.

In contrast, in the embodiment, insertion holes 32*h* on one side are placed outwardly laterally, so that center of gravity G lies inside right and left pins 33, 34 even when the offset placement is employed. Accordingly, when jib 15 is suspended from boom leading end 14*a*, jib 15 is suspended at two points.

(Jib Projection Operation)

In the following, a jib projection operation will be described.

(1) As illustrated in FIG. 1, in a state where jib 15 is in a stowed position, jib 15 is stowed along a side of boom 14.

(2) Firstly, boom 14 is slightly extended. Subsequently, jib 15 is moved to the lower holding position in which jib 15 is placed along the bottom of boom 14. Jib 15 is supported by first jib supporting member 16 and second jib supporting member 17. First jib supporting member 16 is provided with hydraulic cylinder 16*a*. Jib 15 can be turned to the lower holding position by extending hydraulic cylinder 16*a*. Boom 14 is then fully retracted. Accordingly, the state as illustrated in FIGS. 2 and 3 is achieved. In this operation, jib connection shafts 21, 22 are fitted into jib base end engagement portions 31, 32, as illustrated in FIG. 4.

(3) Pins 33, 34 are then inserted into insertion holes 31*h*, 32*h*. Jib base end engagement portions 31, 32 are thus connected to jib connection shafts 21, 22. Tension rod 15*b* provided on jib 15 is also connected.

At this stage, jib 15 is in the offset placement in which jib base end 15*a* is located at boom leading end 14*a*, and the leading end of jib 15 is located laterally from boom 14. As described above, line L connecting right and left insertion holes 31*h*, 32*h* is inclined with respect to plane P1 perpendicular to central axis O of jib 15. Therefore, pins 33, 34 can be inserted into insertion holes 31*h*, 32*h* without interfering with jib connection shafts 21, 22.

Figure 8:
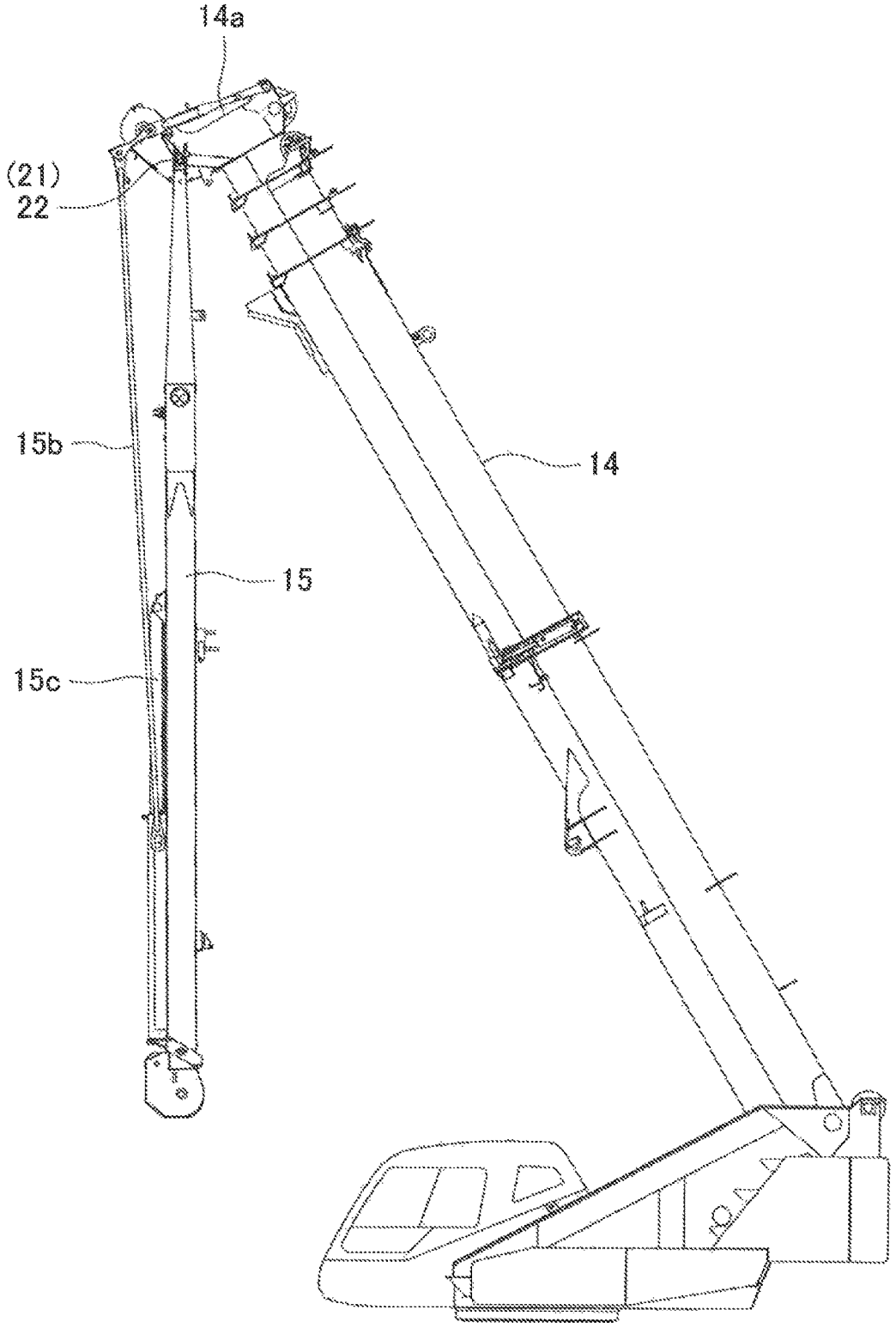
FIG. 8 is a side view illustrating a state where jib 15 is suspended from boom leading end 14*a;*
Figure 9:
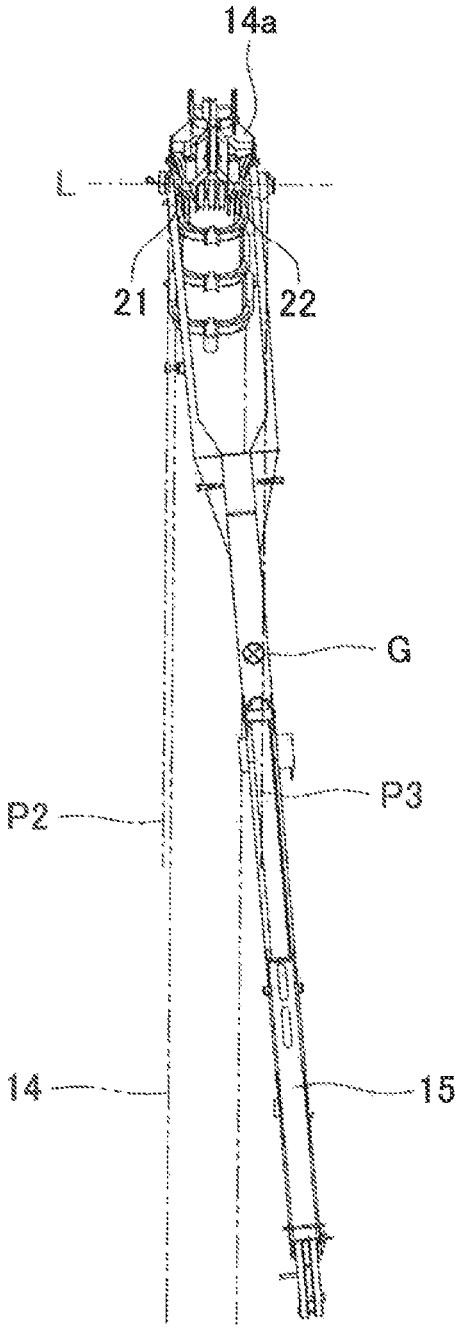
FIG. 9 is a front view illustrating the state where jib 15 is suspended from boom leading end 14*a*.

(4) Boom 14 is then elevated. Subsequently, when boom 14 is slightly extended, first jib supporting member 16 and second jib supporting member 17 are disconnected. Then, as illustrated in FIGS. 8 and 9, jib 15 rotates about jib connection shafts 21, 22 to become suspended from boom leading end 14*a*.

As described above, center of gravity G of the jib lies between two planes perpendicular to line L connecting right and left insertion holes 31*h*, 32*h*, the two planes including respective insertion holes 31*h*, 32*h*. In the state where jib 15 is suspended from boom leading end 14*a*, center of gravity G of jib 15 comes to lie between two vertical planes P2, P3 including respective pins 33, 34. This results in a state where right and left pins 33, 34 are locked to jib connection shafts 21, 22 and jib 15 is suspended at two points. As a result, jib 15 is restrained from swinging sideways, and the jib projection operation is easily carried out.

(5) Tilt cylinder 15*c* is mounted on jib 15. A rod of tilt cylinder 15*c* is connected to tension rod 15*b*.

Figure 10:
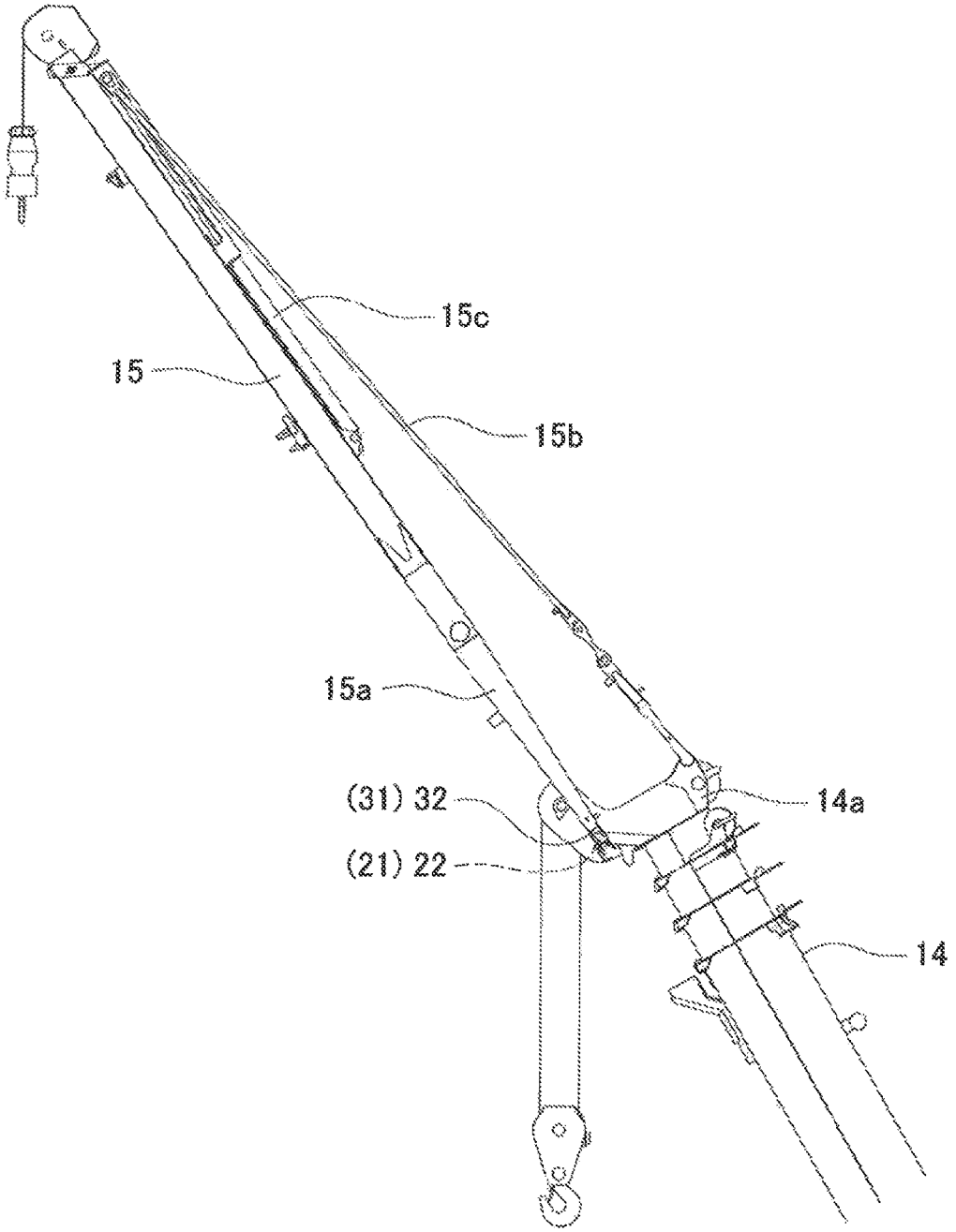
FIG. 10 is a side view illustrating a state where jib 15 is projected.

When tilt cylinder 15*c* is extended, tension can be generated on tension rod 15*b*, and jib 15 can be projected forward from jib connection shafts 21, 22. FIG. 10 illustrates a state where tilt cylinder 15*c* is fully extended, in which jib 15 is in substantially straight alignment with boom 14.

When jib 15 is projected, bottom portions 31*b*, 32*b* of jib base end engagement portions 31, 32 contact with jib connection shafts 21, 22. Accordingly, force acting on jib 15 is transmitted from bottom portions 31*b*, 32*b* of jib base end engagement portions 31, 32 to jib connection shafts 21, 22. No significant force acts on pins 33, 34.

(Jib Stowage Operation)

A jib stowage operation is carried out in a procedure reverse to the jib projection operation. Also in the jib stowage operation, jib 15 is suspended from boom leading end 14*a* in the middle of the jib stowage operation (see FIGS. 8 and 9). Also in this case, right and left pins 33, 34 are locked to jib connection shafts 21, 22 and jib 15 is suspended at two points. As a result, jib 15 is restrained from swinging sideways, and the jib stowage operation is easily carried out.

In the meantime, the distance between right and left insertion holes 31*h*, 32*h* is increased by placing left insertion holes 32*h* laterally outwardly from boom 14. This makes it possible for center of gravity G of jib 15 to lie inside right and left pins 33, 34 and for jib 15 to be supported at two points even in the state where jib 15 is suspended from boom leading end 14*a*.

In order to achieve similar effects, it may also be considered to widen the bifurcated shape of jib base end 15*a*. In this case, however, the distance between bottom portions 31*b*, 32*b* of jib base end engagement portions 31, 32 is also increased. Accordingly, the distances between bases of jib connection shafts 21, 22 (portions connected to jib base end 15*a*) and contact points of jib connection shafts 21, 22 in contact with bottom portions 31*b*, 32*b* of jib base end engagement portions 31, 32 are also increased. As a result, loads acting on the bases of jib connection shafts 21, 22 are greater.

Further, in the case where jib base end 15*a* is widened, jib base end 15*a* in a stowed position protrudes from the bottom of boom 14, to obstruct the view of the operator during vehicle travel.

In contrast, in the embodiment, said problems do not arise since the distance between right and left insertion holes 31*h*, 32*h* is increased without changing the width of jib base end 15*a*. In the meantime, pins 33, 34 only support the weight of jib 15 while jib 15 is suspended from boom leading end 14*a* in the jib projection/stowage operation. For this reason, without an excessive load being caused, even if the width between right and left pins 33, 34 expands, a greater load will not act on the base of jib connection shafts 21, 22.

Increasing the distance between right and left insertion holes 31*h*, 32*h* as in the embodiment provides a higher degree of freedom in designing jib 15. For example, the jib can be longer, and the diameter of the component members can also be increased in order to increase the stiffness. Further, a hydraulic cylinder for tilting and/or extending or retracting jib 15 can be placed on the leading end of jib 15.

REFERENCE SIGNS LIST

14 Boom
14*a* Boom leading end
15 Jib
15*a* Jib base end
21, 22 Jib connection shaft
31, 32 Jib base end engagement portion
32*c* Extension plate
31*h*, 32*h* Insertion hole
33, 34 Pin

The invention claimed is:

1. A jib connection structure being a connection structure between a leading end of a boom and a base end of a jib, the jib connection structure comprising:

a jib connection shaft horizontally projecting in both lateral directions of the leading end of the boom; and jib base end engagement portions provided at respective ends of a bifurcated base end of the jib, wherein the jib base end engagement portions are U-shaped into which the jib connection shaft is allowed to be fitted, and include insertion holes for insertion of pins, the pins being intended for preventing slipping off of the jib connection shaft; and the insertion holes in one of the jib base end engagement portions are placed, when a leading end of the jib is positioned with an offset to one lateral side with respect to the boom, outwardly from a U-shaped bottom portion on the one lateral side, wherein a line that connects right and left insertion holes is inclined with respect to a plane perpendicular to a central axis of the jib, and a center of gravity of the lib lies between two planes perpendicular to the line connecting the right and left insertion holes, the two planes including the respective insertion holes.

2. The jib connection structure according to claim 1, wherein:

the insertion holes are located at a position at which the pins are allowed to be inserted into the insertion holes in a state where the jib connection shaft is fitted into the jib base end engagement portions and the leading end of the jib is placed laterally from the boom, and at which inserted right and left pins are locked to the jib connection shaft in a state where the jib is suspended from the leading end of the boom.

3. The jib connection structure according to claim 1, wherein:

the insertion holes in one of the jib base end engagement portions are placed outwardly from a center of gravity of the jib positioned with an offset to the one lateral side with respect to the boom.

4. The jib connection structure according to claim 1, wherein:

the jib base end engagement portions comprise an extension plate extending outwardly from the U-shaped bottom portion on the one lateral side, and the insertion holes in one of the jib base end engagement portions are provided to the extension plate.

* * * * *